US005162694A

United States Patent [19]

Capek et al.

[11] Patent Number: 5,162,694

[45] Date of Patent: Nov. 10, 1992

[54] SEGMENTED SHADOW MASK SUPPORT STRUCTURE FOR FLAT TENSION MASK COLOR CRT

[75] Inventors: Raymond G. Capek, Elmhurst; Siegfried M. Greiner, Crystal Lake, both of Ill.

[73] Assignee: Zenith Electronics Corporation

[21] Appl. No.: 427,149

[22] Filed: Oct. 25, 1989

[51] Int. Cl.[5] ..... H01J 29/07

[52] U.S. Cl. ..... 313/407; 313/402

[58] Field of Search ..... 313/407, 402

[56] References Cited

U.S. PATENT DOCUMENTS

| | | | |
|---|---|---|---|
| 3,894,321 | 7/1975 | Moore | 313/402 X |
| 4,547,696 | 10/1985 | Strauss | 313/407 |
| 4,595,857 | 6/1986 | Rowe et al. | 313/407 |
| 4,695,761 | 9/1987 | Fendley | 313/407 |
| 4,730,143 | 3/1988 | Fendley | 313/407 |
| 4,737,681 | 4/1988 | Dietch et al. | 313/407 X |
| 4,745,330 | 5/1988 | Capek et al. | 313/407 |
| 4,804,881 | 2/1989 | Strauss | 313/407 |
| 4,828,523 | 5/1989 | Fendley et al. . | |
| 4,891,546 | 1/1990 | Dougherty et al. | 313/407 |

*Primary Examiner*—Palmer C. DeMeo

[57] ABSTRACT

A color cathode ray tube is disclosed that includes a glass faceplate having on its inner surface a centrally disposed, rectangular screen. On each of opposed sides of the screen is plurality of discrete ceramic mask support segments to which are secured a tensed foil shadow mask. A process for fabrication is also disclosed.

14 Claims, 5 Drawing Sheets

SEGMENTED SHADOW MASK SUPPORT STRUCTURE FOR FLAT TENSION MASK COLOR CRT

CROSS-REFERENCE TO RELATED APPLICATIONS

This application is related to but in no way dependent upon copending U.S. applications Ser. No. 140,464 filed Mar. 2, 1988 now U.S. Pat. No. 4,908,495; U.S. Ser. No. 178,175 filed Apr. 6, 1988 now U.S. Pat. No. 4,891,545; U.S. Ser. No. 192,412 filed Jun. 29, 1988 now U.S. Pat. No. 4,866,334; U.S. Ser. No. 223,475 filed Jul. 22, 1988 now U.S. Pat. No. 4,902,257 and its two continuations-in-part: Ser. No. 370,204 filed Jun. 22, 1989 now U.S. Pat. No. 4,973,280 and U.S. Ser. No. 405,378 filed Sep. 8, 1988 now U.S. Pat. No. 4,998,901; U.S. Ser. No. 269,822 filed Nov. 10, 1988 now U.S. Pat. No. 4,891,546; U.S. Ser. No. 421,909 filed Oct. 16, 1989 U.S. Ser. No. 458,129 filed Dec. 28, 1989, all of common ownership herewith.

BACKGROUND OF THE INVENTION

1. Field of the Invention

This invention relates to color cathode ray picture tubes, and is addressed specifically to the manufacture of tubes having shadow masks of the tension foil type in association with a substantially flat faceplate. The invention is useful in the manufacture of color tubes of various types, including those used in home entertainment television receivers, and in medium-resolution and high-resolution tubes intended for color monitors.

The tension foil shadow mask is a part of the cathode ray tube front assembly, and is located in close adjacency to the faceplate. As used herein, the term "shadow mask" means an apertured metallic foil which may, by way of example, be about 0.001 inch thick, or less. The mask is supported in high tension a predetermined distance from the inner surface of the faceplate; this distance is known as the "Q-distance." As is well known in the art, the shadow mask acts as a color-selection electrode, or "parallax barrier," which ensures that each of the three beams generated by the electron gun located in the neck of the tube lands only on its assigned phosphor deposits.

The requirements for a support means for a foil shadow mask are stringent. As has been noted, the foil shadow mask is normally mounted under high tension, typically 30 lb/inch. The support means must be of high strength so the mask is held immovable; an inward movement of the mask of as little as 0.0002 inch can cause the loss of guard band. Also, it is desirable that the shadow mask support means be of such configuration and material composition as to be compatible with the means to which it is attached. As an example, if the support means is attached to glass, such as the glass of the inner surface of the faceplate, the support means must have a coefficient of thermal expansion compatible with the glass, and by its composition, be bondable to glass. Also, the support means should be of such composition and structure that the mask can be secured to it by production-worthy techniques such as electrical resistance welding or laser welding. Further, it is essential that the support means provide a suitable surface for mounting and securing the mask. The material of which the surface is composed should be adaptable to machining or other forms of shaping so that it can be contoured into near-perfect flatness so that no voids between the metal of the mask and the support structure can exist to prevent the positive, all-over contact required for proper mask securement.

To forestall cracking or spalling of the glass of the faceplate resulting from the stress inherent in the cementing of the support structure to the glass of the faceplate, it is essential that the coefficients of thermal contraction ("CTC") of the glass of the faceplate, the metal of the tension mask support structure, and the devitrifying solder glass (known coloquially as "frit"), used as the cement, be compatible. For example, the metal used in conjunction with the support structure may comprise Alloy No. 27 manufactured by Carpenter Technology of Reading, Pa.; this material has a CTC of approximately 105 to $109\times10^{-7}$ in./in./degree C. over the range of the temperatures required for devitrification—from ambient temperature to 450 degrees C. Faceplate glass such as that supplied by Corning Glass Works, Corning, N.Y. under the designation 9068, has a CTC of approximately $100\times10^{-7}$ in./in/degree C. from 300 degrees C. to room temperature. Solder glass 7590, also supplied by Corning Glass Works, has a CTC of $97\times10^{-7}$ in./in./degree C. from 300 degrees C. to room temperature. This range of CTC's is about as compatible as it is possible to achieve with this range of materials, and makes feasible the cementing of them together under the wide temperature variations required in tube manufacture.

It is desirable in some applications to provide a mask support system, including cement, having a composition effective to place the glass beneath the support system into a predetermined degree of tension. This concept is described and claimed in referent copending application Ser. No. (D5937), of common ownership herewith.

It has been found that the cementing of a support structure to the glass of the faceplate can appreciably distort the faceplate if the mismatch is great enough. In the practical utilization of interchangeable mask systems, such as those set forth in referent copending application Ser. No. 223,475 and its two continuations-in-part: Ser. Nos. 370,204 and 405,378, it is important that the faceplate be as flat as possible, and that it remain flat throughout the wide temperature excursions incident to the process of cathode ray tube manufacture. Any excessive out-of-plane distortion may bring into question the feasibility of interchangeable mask systems in flat tension mask tubes.

Significant factors in the manufacture of a tension mask support structure include: (1) the cost of the materials of the structure; (2) the compatibility of the composition of the support structure with the glass of the faceplate; and (3) the flatness/parallelism of the structure.

The requirement for flatness and parallelism remains the same regardless of the length of the rails, which in turn is determined by the size of the tube; the longer the rail, the greater the problems in its fabrication, and the greater its cost. Also, the longer the rail, the greater any effect of the incompatibility of the materials of rail and faceplate, and hence the greater the resulting distortion of the faceplate.

In consequence, there has been a very real limitation on the potential size of flat tension mask cathode ray tubes. It is an objective of the present invention to resolve the size-limitation and the related problems.

2. Prior Art

U.S. Pat. No. 4,730,143 to Fendley, of common ownership herewith, and its reissue application Ser. No. (D5261-R), disclose a color cathode ray tube having a faceplate-mounted mask support structure with a welded-on, high-tension foil shadow mask. The faceplate of the tube has on its inner surface a centrally disposed phosphor target surrounded by a peripheral sealing area adapted to mate with a funnel. A separate metal faceplate frame is secured to the inners surface of the faceplate between the sealing area and the target. The separate metal frame supports a welded-on tension foil shadow mask a predetermined distance from the inner surface of the faceplate. The separate face-mounted frame has, according to the '143 invention, a plurality of slurry-passing structures contiguous to the inner surface of the faceplate for passing any surplusage of slurry during the radial-flow, slurry-deposition process used in screening the faceplate. In one embodiment of the invention, a faceplate-mounted metal frame is shown as being discontinuous ("broken") or segmented. Gaps in the metal frame provide for the passage of slurry used in screening, and the discontinuities in the metal of the support structure are said to compensate for differences in the coefficients of thermal expansion or contraction of the metal of the support structure and the glass of the faceplate. The foil shadow mask is indicated as being welded directly to the metal of each discrete part of the support structure.

Other Prior Art

U.S. Pat. Nos.
3,894,321 to Moore
4,547,696 to Strauss
4,595,857 to Strauss et al
4,695,761 to Fendley
4,737,681 to Dietch et al
4,745,330 to Capek et al
4,828,523 to Wichman et al

OBJECTS OF THE INVENTION

It is a general object of the invention to provide means and a process for facilitating the manufacture of color cathode ray tubes having a tensed foil shadow mask.

It is an object of this invention to provide a process for use in the manufacture of tension mask faceplate assemblies that simplifies manufacture and reduces manufacturing costs.

It is an object of this invention to provide a resolution to the problems of incompatibility of the materials of a tension mask support structure and the faceplate to which it is attached.

It is another object of the invention to provide means and a process for manufacturing color cathode ray tubes that provide resolution and image size useful in high-definition television systems.

It is another object of this invention to provide means and process that will maintain the flatness of the faceplate of a tension mask tube during thermal production cycles.

It is a further object of this invention to provide means and process that make feasible the manufacture of the relatively large flat tension mask color cathode ray tubes for use in commercial television and in video monitors.

It is yet another object of this invention to provide means and process that make feasible the manufacture of flat tension mask color cathode ray tubes having interchangeable shadow masks.

It is another object to provide structure and production method permitting use of a ceramic mask support structure in a large screen cathode ray tube without the cost and fabrication obstacles attending the use of lengthy mask support rails.

It is still another object to meet the afore-stated objective with a mask-support structure which is easy to handle in production.

It is yet another object to provide a tension mask support structure having improved flatness and Q-height uniformity.

BRIEF DESCRIPTION OF THE DRAWINGS

The features of the present invention which are believed to be novel are set forth with particularity in the appended claims. The invention, together with further objects and advantages thereof, may be best understood by reference to the following description taken in conjunction with the accompanying drawings (not to scale), in the several figures of which like reference numerals identify like elements, and in which:

DESCRIPTION OF THE PREFERRED EMBODIMENT

Figure 1:
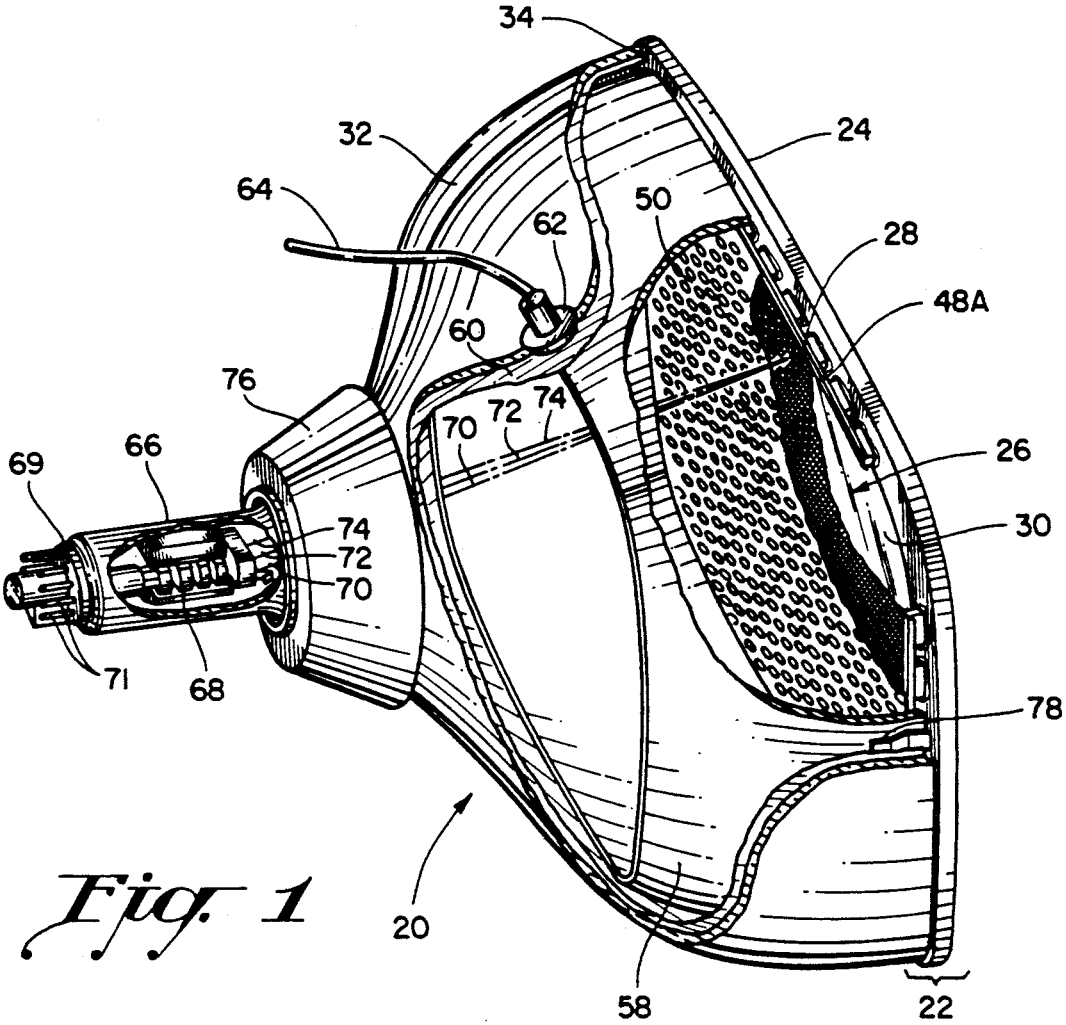
FIG. 1 is a side view in perspective of a tension mask color cathode ray tube having the structure and subject to the means and processes of this invention, with cutaway sections that indicate the location and relation of the major components of the tube.
Figure 2:
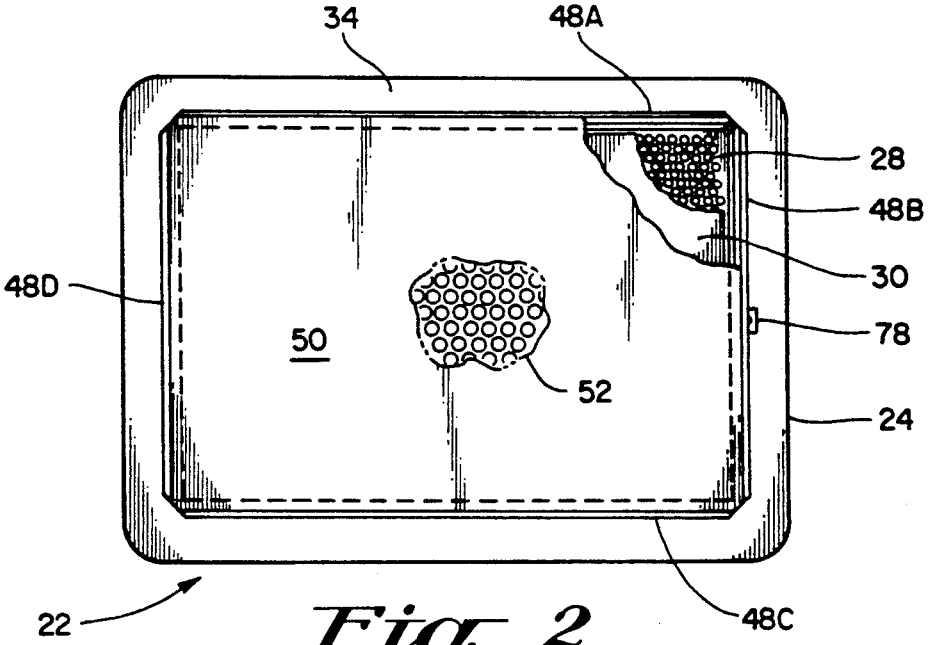
FIG. 2 is a plan view of the front assembly of the tube shown by FIG. 1, with parts cut away to show the relationship of the faceplate with the mask support structure and shadow mask; insets show greatly enlarged mask apertures and phosphor screen patterns.
Figure 3:
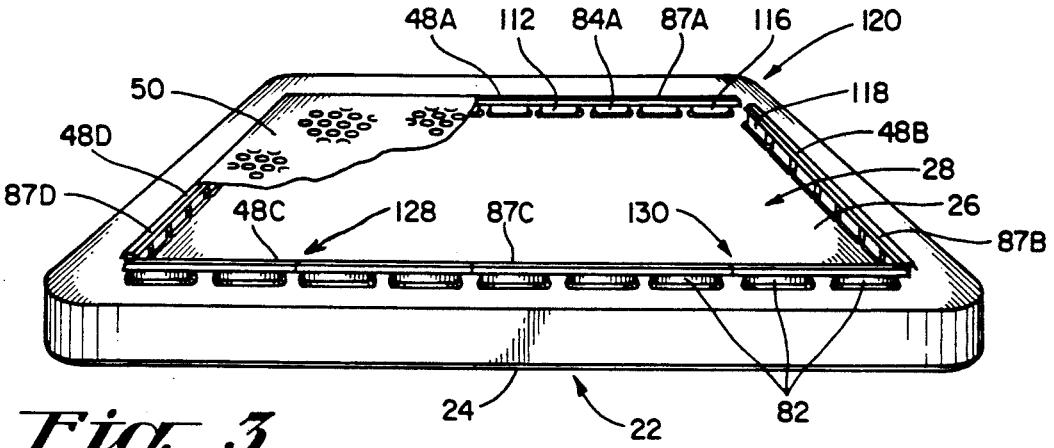
FIG. 3 is a view in perspective of a cathode ray tube faceplate having a segmented shadow mask support structure according to the invention mounted thereon.

A color cathode ray tube having a segmented support structure according to the invention is depicted in FIGS. 1, 2 and 3. The tube and its component parts are identified in the figures, and described in the following paragraphs in this sequence: reference number, a reference name, and a brief description of structure, interconnections, relationship, functions, operation, and/or result, as appropriate.

20 color cathode ray tube
22 front assembly
24 glass faceplate
26 inner surface of faceplate
28 centrally disposed phosphor screen on inner surface 26 of faceplate 24; the round deposits of phosphor, shown as surrounded by the black matrix, are depicted greatly enlarged
30 film of aluminum
32 funnel
34 peripheral sealing area of faceplate 24, adapted to mate with the peripheral sealing area of funnel 32
48 shadow mask support structure according to the invention noted as comprising four discrete "rails" 48A, 48B, 48C and 48D located on opposed sides of the screen 28 and secured to inner surface 26 of faceplate 24
50 metal foil shadow mask; after being tensed, the mask is mounted on support structure 48 and secured thereto
52 shadow mask apertures, indicated as greatly enlarged in the inset for illustrative purposes; there is one aperture for every triad of phosphor deposits
58 internal magnetic shield
60 internal conductive coating on funnel
62 anode button
64 high-voltage conductor
66 neck of tube
68 in-line electron gun providing three discrete in-line electron beams 70, 72 and 74 for exciting the respective red-light-emitting, green-light-emitting, and blue-light-emitting phosphor deposits on screen 28
69 base of tube
71 metal pins for conducting operating voltages and video signals through base 69 to electron gun 68
76 yoke which provides for the traverse of beams 70, 72 and 74 across screen 28
78 contact spring which provides an electrical path between the funnel coating 60 and the mask support structure 48 and shadow mask 50.

With reference to FIG. 3, a color cathode ray tube according to the invention includes a glass faceplate 24 having on its inner surface 26 a centrally disposed, rectangular screen 28. A metal foil shadow mask 50 is mounted in tension on a mask support structure 48 shown as being located on opposed sides of screen 28 and secured to the inner surface 26 of faceplate 24. The support structure on each side of the screen is shown as comprising a predetermined plurality of discrete spaced segments 82 composed of ceramic to which are secured the tensed foil shadow mask 50. The mask will be noted as being secured to bridging members 87A, 87B 87C and 87D; indicated as bridging the segments.

Segmented mask support structure 48 according to the invention is depicted as consisting of four discrete sections 48A, 48B, 48C and 48D, referred to herein as "rails." The faceplate, and the screen, are based on an aspect ratio of 3 to 4. Rails 48A and 48C are known as "long rails" because they are located on the long sides of the faceplate; similarly, the "short" rails 48B and 48D are located on the short sides of the faceplate. The "long rail" and "short rail" terminology is used throughout this disclosure.

Figure 4:
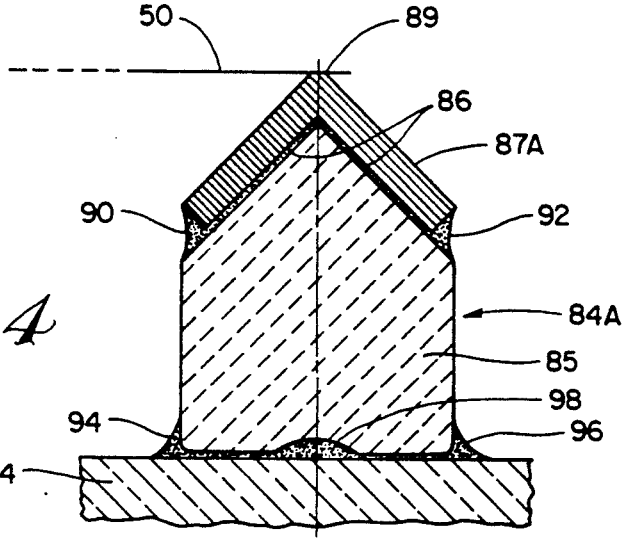
FIG. 4 is a view in elevation of a cross-section of a preferred embodiment of a segmented mask support structure according to the invention.

A preferred embodiment of a segmented support structure according to the invention is depicted in cross-section and greater detail in FIG. 4. A typical segment 84A, indicated in FIG. 3 as being a segment located in rail 48A, is shown as having a body of ceramic 85, indicated symbolically, and has in cross-section the aspect of a house with a saddle roof with sloping sides 86 over which is folded a bridging member 87A, shown symbolically as being composed of metal. Bridging member 87A provides for bridging the segments and receiving and securing shadow mask 50 on flat peak 89, which may have a ground surface; the securement means is preferably that of laser weldment. Laser welding means for securing a foil mask to a support structure is not the subject of the present application, but that of U.S. Pat. No. 4,828,523 of common ownership herewith. The "house" cross-sectional configuration depicted is the subject referent copending application Ser. No. 269,822, wherein the configuration is fully described and claimed.

The bridging members may comprise Alloy No. 27 manufactured by Carpenter Technology of Reading, Pa.; this material has a CTC of approximately 105 to $109\times10^{-7}$ in/in/degree C. over the range of the temperatures required for devitrification—from ambient temperature to 450 degrees C. Alloys having equivalent characteristics supplied by other manufacturers may as well be used.

Bridging member 87A is indicated as being secured to the sloping sides 86 of segment 84A by deposits 90 and 92 of cement, indicated by the stipple pattern. The cement may comprise a devitrifying solder glass such as, for example, solder glass No. CV-685 manufactured by Owens-Illinois of Toledo, Ohio. Alternately, bridging member 87A may be secured to the sloping sides 86 of ceramic body 85 by a porcelain enamel such as that manufactured by Mobay Corporation, Baltimore, Md., under the designation QJ350. This product, which is supplied in the form of a powder, is preferably mixed with amyl acetate and nitrocellulose to make a paste of workable viscosity. Heating incidental to the manufacturing process results in setting of the enamel and firm adhesion of the metal of bridging member 87A to the ceramic body 85.

The ceramic body 85 of segment 84A is indicated as being secured to the glass of faceplate 24 by deposits 94 and 96 of cement, which comprises a devitrifying solder glass according to the invention. The parameters of the mask support system, including the composition of the solder glass, is preferably effective to place the glass of the faceplate beneath at least selected ones of the segments into a predetermined degree of tension, as set forth in referent copending application Ser. No. 458,129.

Faceplate glass such as that supplied by Corning Glass Works, Corning, N.Y. under the designation 9068, has a CTC of $100\times10^{-7}$ in./in./degree C. from 300 degrees C. to room temperature. Solder glass 7590, also supplied by Corning Glass Works, has a CTC of $97\times10^{-7}$ in./in./degree C. from 300 degrees C. to room temperature; the CTC from 450 degrees C. (the maximum processing temperature required for devitrification of the solder glass) to room temperature, is $98\times10^{-7}$ in./in./degree C. Thus the composition of the solder glass provides for a cementing medium having a CTC less than that of the faceplate, one effective, with appropriate other parameters of the overall mask support system, to place the glass of the faceplate beneath at least selected ones of the segments into a predetermined degree of tension.

This desirable effect is aided by groove 98 in the area of securement of the segment 84A to the faceplate 24. This groove, which runs lengthwise in the ceramic body 85 of segment 84A, provides for receiving and forming a lengthwise bead of cement. The assembly is constructed and arranged to pre-stress the faceplate in the area of interface with the mask support structure to enable the assembly to tolerate wide temperature excursions experienced during production. The concept of a lengthwise groove in a mask support structure is the subject of copending application Ser. No. 458,129, of common ownership herewith.

A preferred composition for the ceramic component of the segments of the support structure according to the invention comprises, in percentages, magnesia, 27; talc, 63; barium carbonate, 6; and ball clay, 4. The coefficient of thermal contraction of this composition, when used for at least selected ones of the segments, is effective to put the glass beneath the segments into a predetermined degree of tension, such as, by way of example, a tension of greater than 800 psi. As a result, the tube assembly can withstand the wide temperature excursions experienced during production. The composition of ceramic cited, and the effect different compositions may have on the glass of the faceplate, is not the subject of the present application, but that of referent copending patent application Serial No. (D5937).

Figure 5C:
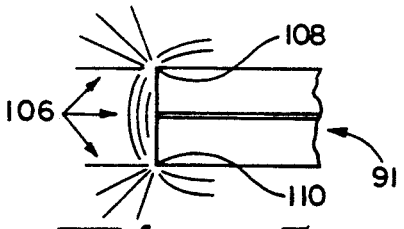
FIG. 5C is a fragmentary top view of a hypothetical segment having ends which are square.
Figure 5A:
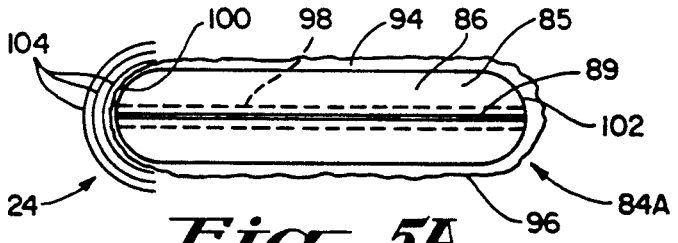
FIG. 5A and 5B are top and side views, respectively, of one segment of the FIG. 3 mask support structure having rounded ends according to the invention.
Figure 5B:
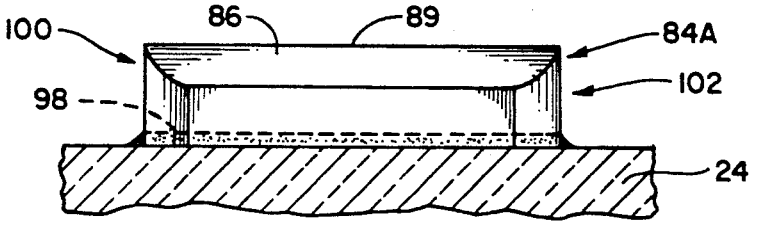

Additional details of the configuration of the ceramic body 85 of a typical segment 84A are shown by FIGS. 5A and 5B. Ceramic body 85 of segment 84A is indicated as having rounded ends 100 and 102 configured to minimize stresses in the faceplate inner surface; the ends of all other segments are shown as being similarly rounded. (Note the fillets of solder glass 94/96 at the base of segment 84A.) The benefit of the rounding of ends 100 and 102 is indicated by symmetrical stress lines 104 which appear in the glass of the faceplate to which segment 84A is attached; i.e., there is no intersection or concentration of the stress lines 104, indicating a uniform and not excessive stress in the glass.

If the ends were square rather than rounded, as indicated by hypothetical segment 91 shown by FIG. 5C, the stress lines 106 that would be present in the glass of the faceplate to which segment 91 is attached would appear substantially as depicted; the convergence of stress lines at corners 108 and 110 would very likely induce cracking and spalling of the glass at the points of convergence.

Figure 6:
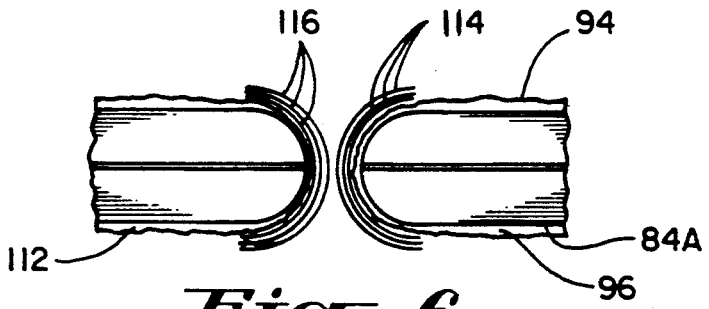
FIG. 6 is a top view of two abutting sections of a segmented mask support structure according to the invention, with a representation of the stress lines which exist in the faceplate glass to which the structure is attached.

The segments are spaced apart according to the invention a distance effective to prevent intersection of stress lines in the faceplate glass which emanate from the ends of the segments; otherwise, intersecting stress lines can create areas of high stress in the glass to which the segments are attached. The desired spacing between segments is indicated in FIG. 6, which depicts the adjacency of the rounded ends of two segments 84A and 112. The respective stress lines 114 and 116, noted as being in the glass of the faceplate, are shown as not overlapping, and therefore, minimizing stresses in the faceplate inner surface. The desired spacing of segments 84A and 112 is about ⅜ inch, by way of example.

To facilitate manufacture, the metal bridging members may be first formed as a unitary frame to which the discrete segments are attached. The segments are then secured to the faceplate and the frame is severed at the corners to form, according to the invention, the four discrete, segmented rails 48A–48D indicated in FIG. 3.

Figure 7:
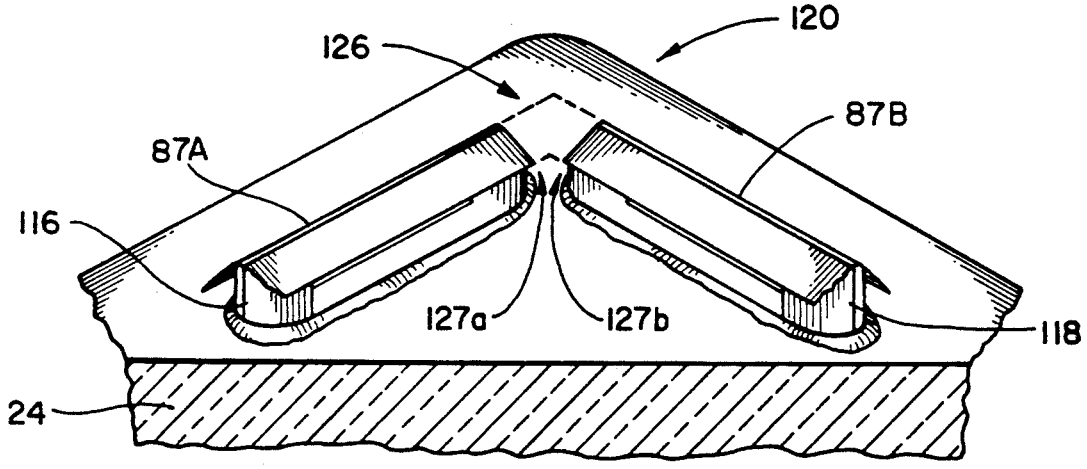
FIG. 7 is an enlarged perspective view of the intersection of two corner sections of the segmented mask support structure shown in FIG. 3.

FIG. 7 depicts the relationship of segments 116 and 118 of the two discrete, segmented rails 48A and 48B located in corner area 120 of faceplate 24 (see FIG. 3). The area of separation 126 is indicated by the dashed lines, and may comprise, by way of example, a separation of about ¼ inch. The severing of the frame may be accomplished by saw means which cut the bridging members 87A and 87B apart after the support structure is attached to the faceplate. Prior to their attachment to the faceplate and their separation, the conjoined rails provide for easy handling in production. Following attachment to the faceplate and their separation, the mask support structure can freely expand and contract under the temperature excursions experienced in production. It has been found that the small hiatus in the support of the tensed mask at the corners provided by the area of separation 126 has no deleterious effect on the overall integrity of the support structure.

The bridging members 87A and 87B will be noted as overhanging the respective underlying ceramic segments 116 and 118; the overhangings, indicated by reference Nos. **127*a* and 127*b***, are of the order of about 1/10 of an inch. The overhanging of the bridging members of the segmented mask support structure act to provide for a smooth transition of the cement used to attach the bridging members to the underlying ceramic body, thus avoiding the presence of pockets which might otherwise harbor contaminants deposited during the production process.

The bridging members according to the invention preferably have at least one thermal expansion gap therein. With reference to FIG. 3, two such gaps 128 and 130 are indicated roughly equidistant in bridging member 87C of rail 48C. Gaps 128 and 130 are shown as being located between two adjacent segments of the rail 48. The purpose of the gaps is to further relieve the stress on the faceplate inherent in the attachment of the rails to it. The gaps are preferably cut with a saw having the smallest possible kerf; e.g., 1/32 of an inch. Experiments have shown that such gaps have little or no effect on the structural integrity of the support structure after it is cemented to the faceplate.

Figure 8A:
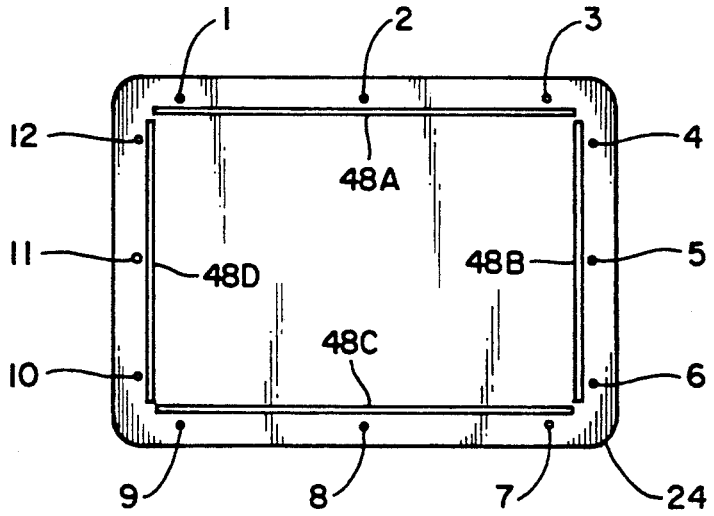
FIG. 8A is a plan view of the inner surface of a faceplate having a segmented mask support structure according to the invention, showing the location of points for measuring the stress on the faceplate.
Figure 8:
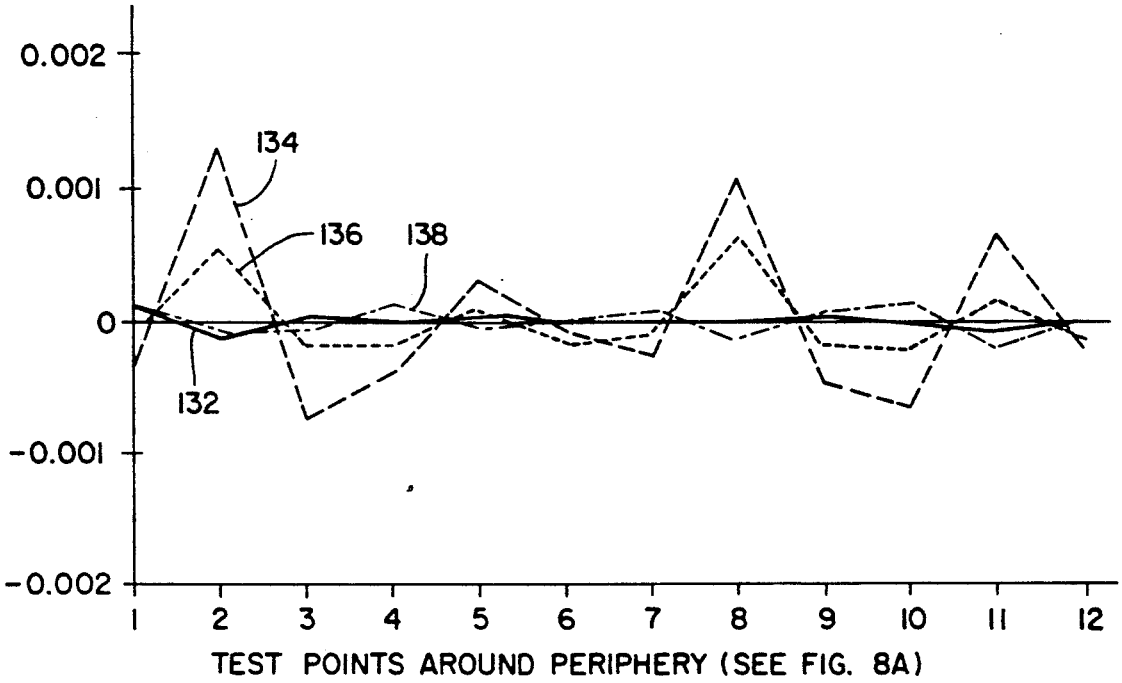
FIG. 8 is a graph indicating by comparison the beneficial effects of a segmented support structure according to the invention.

The benefits of thermal expansion gaps according to the invention are indicated graphically in FIG. 8. As explained below, the deflection of a glass faceplate is indicated under conditions of (a) no support structure, (b) a continuous (unsegmented) ceramic support structure, (c) a segmented ceramic support structure according to the invention, and (d) a segmented ceramic support structure like the structure in (c), but having two gaps therein (see gaps 128 and 130 in FIG. 3). The faceplate under test had a thickness of 0.520 inch, and face dimensions of 10-¾ inches by 13-7/16 inches; the diagonal measure of the faceplate was 17.552, or 17-9/16 inches. In FIG. 8, the test point locations on the long rails and short rails are indicated on the X-axis, and the deflection of the faceplate in inches is indicated on the Y-axis.

FIG. 8A indicates the location on the faceplate of test points 1 through 12 indicated in FIG. 8. It will be noted that the test points are located immediately outside of the rails 48A–48D, and outside the solder glass fillets indicated by reference numbers 94 and 96 in FIG. 4. The location of the test points is the result of measurements that indicated that the greatest deflection of the faceplate from stress caused by the rail attachment is adjacent to the rails.

In conditions (b), (c) and (d) in which a support structure was secured to the faceplate, securement was by means of the devitrified glass frit described in the foregoing. In the process, the faceplates under test were passed through a lehr in which they were heated to a temperature of 450 degrees C. to accomplish devitrification of the solder glass and the permanent attachment of the segments to faceplate. In condition (a), in which no support structure was attached to the faceplate, the faceplate alone was passed through the same lehr to determine its deflection due to heating.

Measurements of deflection were made by means of a dial gage indicator having an accuracy of ±0.0001 inch.

In more detail, deflection of the glass faceplate under the four test conditions is indicated in FIG. 8 by these lines:

(a) line 132 (solid), no support structure (b) line 134 (long dashes), an unsegmented support structure (c) line 136 (short dashes), a segmented support structure (d) line 138 (long and short dashes), a segmented support structure with two thermal expansion gaps in each rail.

The beneficial effect of condition (c), line 136, a segmented support structure according to the invention, is readily apparent when compared with condition (b), line 134, an unsegmented support structure, in that faceplate deflection is significantly less. The beneficial effect will be seen to be markedly greater under condition (d), line 138, a segmented structure with gaps according to the invention, in that faceplate deflection is comparable to that of a faceplate having no support structure at all thereon.

This may be understood as follows. The composite structure comprising the faceplate, the ceramic structure and the metal bridging member, have a tri-metal effect. The bridging member has the highest CTC, the ceramic structure the lowest. Upon cooling, the glass will exert the greatest effect, bowing the composite structure upwardly. We see the greatest deflection of the faceplate when the ceramic and bridging member are both continuous (see graph line 134). When the ceramic structure is broken, as by segmentation (see graph line 136), the bi-material effect between the ceramic and the glass is lessened and the glass will tend to return to its natural state. However, the composite ceramic-metal structure is still acting against the glass. When the bridging member is also severed (see graph line 138), the tri-material or bi-material effect is almost completely eliminated and the glass returns to a state closely approximating its natural state. We see that graph line 138 closely approaches graph line 132 depicting the glass in its free state without any mask support structure attached.

Figure 9:
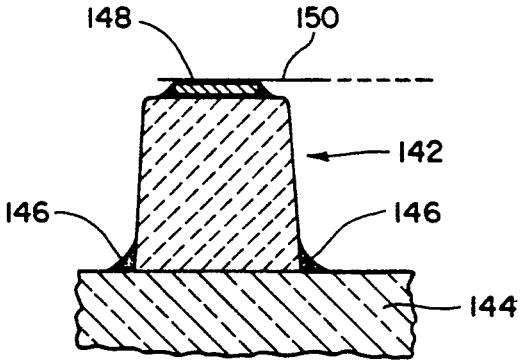
FIG. 9 is a cross-sectional, detail view in elevation of a typical segment of another embodiment of a segmented mask support structure according to the invention.

Another embodiment of a segmented mask support structure according to the invention is depicted in FIG. 9, in which a cross-section view of a segment 142 is indicated. Segment 142, which is one of a predetermined plurality of discrete, spaced ceramic segments such as are shown in FIG. 3, is depicted as being secured to a glass faceplate 144 by deposits 146 of solder glass. Segment 142 is indicated as having a bridging member 148 affixed thereto for receiving and securing a shadow mask 150. Bridging member 148, indicated as comprising a flat strip, bridges the segments of the support structure according to the invention.

Figure 10:
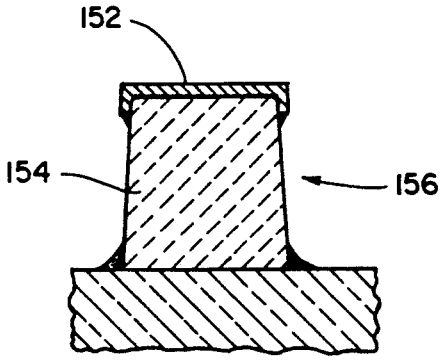
FIGS. 10 and 11 are cross-sectional, detail views in elevation of typical segments of further embodiments of a segmented mask support structure according to the invention.
Figure 11:
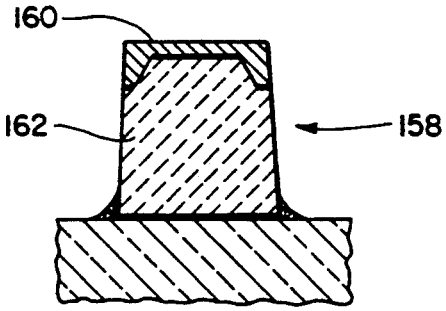

Other configurations of the segments of a segmented mask structure according to the invention are depicted in cross-section FIGS. 10 and 11. In FIG. 10, the bridging member 152 is shown as being in the form of a "crown" that overlaps the sides of the ceramic body 154 of the segment 156. In FIG. 11, segment 158 is shown as having a bridging member 160 in the form of a crown mortised into the ceramic body 162 of the segment. The configurations depicted by FIGS. 9–11 are disclosed in U.S. Pat. No. 4,737,681 of common ownership; it is noted that the configurations in the '681 patent comprise continuous, rather than segmented, rails.

Shadow mask support structures having a body comprised of a ceramic, and with a metal component for the attachment of a foil shadow mask, are further described in referent U.S. Pat. Nos. 4,737,681 and 4,745,330 of common ownership herewith, and in referent copending applications Ser. Nos. 178,175 and 192,412, also of common ownership.

As noted, the amount of stress exerted on the glass of the faceplate, and resultant deflection, can be controlled by (a) the composition of the ceramic, and/or (b), the composition of the solder glass used to attach the segments to the glass. Also as noted, a segmented support structure according to the invention may comprise four discrete rails secured on opposed sides of the screen—two longer rails on the long side of the faceplate, and two shorter rails on the short side of the faceplate. In the table that follows, the CTC of the ceramic segments is the variable, and the effect on the glass, whether stressed or unstressed by the attachment, depends on the CTC of the ceramic used to form the segments. The lengths of segments are dependent upon the screen size of the cathode ray tube, as shown by way of example in Table I. (Dimensions are in inches.)

TABLE I

SEGMENT DIMENSIONS IN RELATION TO SCREEN SIZE

| Screen Size (diagonal measure) | 14V | 20V | 25V | 30V | 35V |
|---|---|---|---|---|---|
| Screen Area | | | | | |
| Height | 8.4 | 12 | 15 | 18 | 21 |
| Width | 11.2 | 16 | 20 | 24 | 28 |
| Number of | 5 | 7 | 8 | 10 | 11 |
| Segments | 6 | 9 | 11 | 13 | 15 |
| Lengths of | 1.4 | 1.4 | 1.51 | 1.47 | 1.57 |
| Segments | 1.57 | 1.45 | 1.48 | 1.50 | 1.52 |

For the 14 V tube, for example, it will be seen that there are five segments each having a length of 1.4 inches along each of the short rails, and six segments each having a length of 1.57 inches along each of the long rails.

Studies have shown that deflection of the faceplate resulting from the attachment of a support structure to a faceplate is greatest at the midpoint of the long rails; that is, at test points 2 and 8 in FIG. 8A. Deflection is somewhat less at the midpoint of the short rails—test points 5 and 11—with the least deflection at the corners. Pre-stressing the glass beneath the segments located at the ends of the rails—the area of the faceplate most likely to fail—increases the ability of the tube to withstand wide temperature excursions at high temperature rates, while minimizing stress in mid-portions; the result is a strong tube envelope with minimum faceplate deflection.

This strengthening with minimum deflection is accomplished by using segments having a ceramic composition with a lower CTC at the corners, resulting in a pre-stressing of the system. The composition of segments in mid-portions is preferably such that the CTC is close to that of the glass of the faceplate. For example, if ceramic segments close to the CTC of the glass (98–99$\times$ 10$^{-7}$ in./in./degrees C.) are desired for the midpoints of the support structure (designated "G-type", with G standing for "glass") in the following table, and segments of low CTC (94–95$\times 10^{-7}$ in./in./degrees C. (designated "P-type", with P standing for "pre-stress"), the arrays of segments will be as indicated in Table II. The G-type segments are noted as being located at or near the center of the rails, while the P-type segments are located at or near the ends of the rails.

TABLE II

| TYPE AND NUMBER OF SEGMENTS IN RELATION TO SCREEN SIZE | | | | | |
|---|---|---|---|---|---|
| Screen Size | 14V | 20V | 25V | 30V | 35V |
| Number of Segments: | | | | | |
| Short rails | 5 | 7 | 8 | 10 | 11 |
| Long rails | 6 | 9 | 11 | 13 | 15 |
| Types of Segments: | | | | | |
| Short Rails | 4P | 4P | 4P | 6P | 6P |
| | 1G | 3G | 4G | 4G | 5G |
| Long Rails | 4P | 4P | 6P | 6P | 8P |
| | 2G | 5G | 5G | 7G | 7G |

For example, with regard to the 14 V tube, there will be five segments in each of the short rails comprising four pre-stressed P-type segments, with a single G-type segment centered in each rail, for a total of five segments. With regard to the long rails of the 14 V tube, there will be four P-type segments, with two G-type segments in the center, for a total of six segments.

With respect to the smaller faceplates which have fewer segments, such as the 14 V and 20 V, the CTC of the ceramic of the segments can be adjusted so that there is a smaller differential between the G- and P-type segments. That is, rather than use a larger number of smaller segments to provide a greater degree of adjustment, segments having a CTC of 96–97$\times 10^{-7}$in./in./degree C. can be used for the G-type, and fewer of them are then needed.

It is noted that, rather than using solder glasses CV685 or 7590 previously described, special solder glass compositions having lower CTC's, such as Corning Glass Works No. 7575 can be used to provide the desired increased pre-stress in the corners.

Longer segments, and fewer of them, can be used in the larger tubes because the faceplate is more resistant to deflection because of the increased thickness of the glass. For example, the faceplate of a 35 V tube is about 1.25 inch thick. Only six segments will be needed for the shorter rails in this tube, and eight segments for the longer rails. Segment length can be about 3.2 inches for all such segments.

Figure 12:
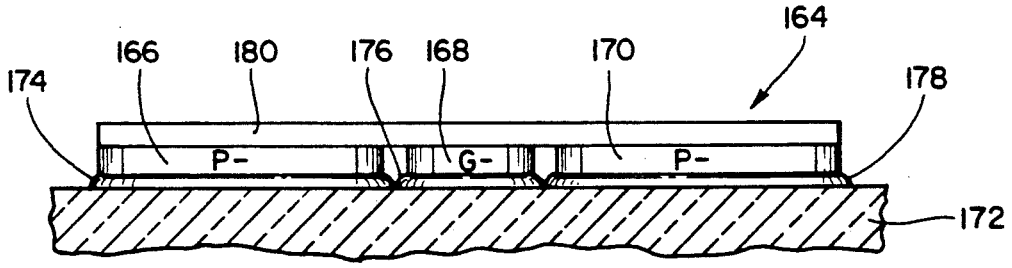
FIGS. 12 and 13 are side views in elevation of other embodiments of a segmented mask support structure according to the invention.

The segments have been depicted heretofore as being of equal length. According to the invention, at least selected ones of the segments have different lengths in a conformation effective to disperse stress in the glass of the faceplate, including an end segment which is longer than a centrally located segment. Segments having different lengths are indicated in FIG. 12, which depicts a short rail 164 intended for a 14 V tube, by way of example. Three segments 166, 168 and 170 are depicted as being affixed to a faceplate 172, with the means of attachment indicated by beads of solder glass 174, 176 and 178. The segments are shown as being bridged by a bridging member 180, according to the invention. With reference to Table II, the short rail of a 14 V tube is described by the Table as having five segments comprised of four P-type segments and one G-type segment, with the latter segment located in the middle of the rail. In the configuration of short rail 164 indicated by FIG. 12, the four P-type segments normally located at the ends of the rail are indicated as having been combined according to the invention into two P-type segments 166 and 170, with the single G-type segment 168 located at the center of the rail.

Figure 13:
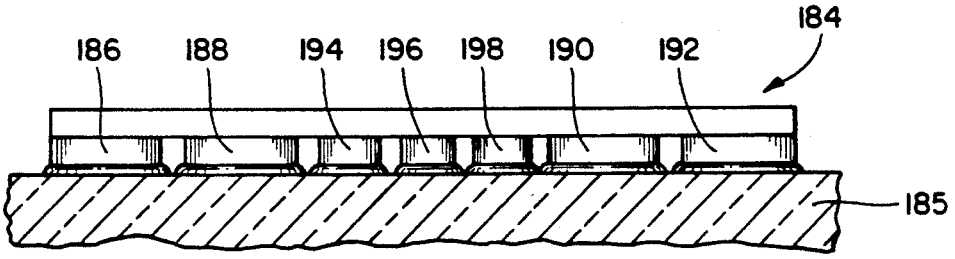

Another example follows which indicates how segments may vary in length according to the invention, and how they may be combined into fewer segments when used in larger tubes requiring longer rails. With reference to Table II, it is noted that the table lists the number of segments of a "short rail" of the 35 V screen (in a 35-inch diagonal measure tube) as 15, comprising eight P-type and seven G-type segments. A "short" rail, in which the 15 segments are combined, is indicated by rail 184 in FIG. 13, shown as attached to faceplate 185 (not to scale). The eight P-type segments have been combined into four segments 186, 188, 190 and 192, and located at or near the ends of rail 184. The seven G-type segments have been combined into three segments 194, 196 and 198 located at or near the middle of rail 185. The unequal rail lengths according to the invention will be noted.

Fabrication of Ceramic Segments

The number of the segments, and their length and width, is a function of the dimensions of the faceplate of the tube in which they are to be used. The height of the segments in the rails is based on the desired Q-height, which varies with the size of the tube in which the segment is to be used, and the pitch of the associated mask. For example, the Q-height of tube with a 14-inch diagonal measure and 0.3 mm pitch is about 9/32 of an inch, while a tube with a 35-inch diagonal measure and a pitch of 0.3 mm requires a Q-height of about one inch.

Figure 14:
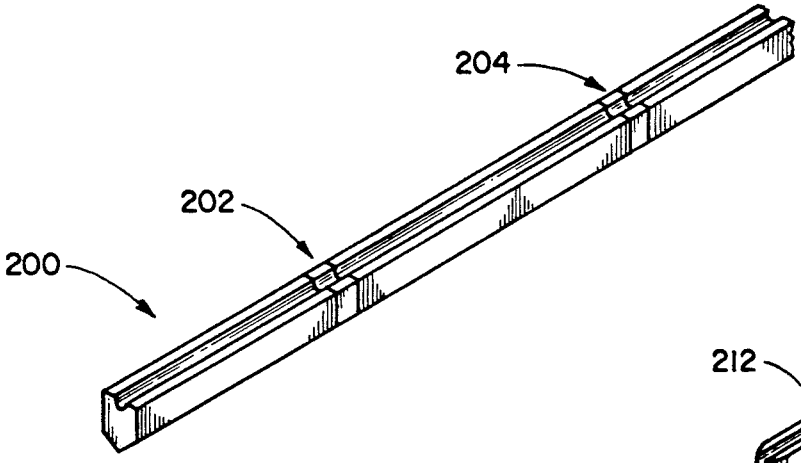
FIGS. 14 and 15 are perspective views of in-process mask support structures indicating structural configurations that facilitate manufacture.

Rails can be made by extrusion, preferably in the form indicated by FIG. 14 in which a train of segments 200 is shown upon emerging from the extruder. Before sintering, the extruded segments are dried and cut apart on the bottom side by a saw at the locations 202 and 204 indicated. Fifty or more rails can be cut apart simultaneously using a gang saw. The ends of each segment can be rounded before or after sintering by means of a shaping tool. The sintered segments are then placed in a holding fixture and the bridging member (indicated by ref. No. 87A in FIGS. 3 and 4) is then cemented to the segments by means of a devitrifying frit or an enamel, as heretofore described.

Figure 15:
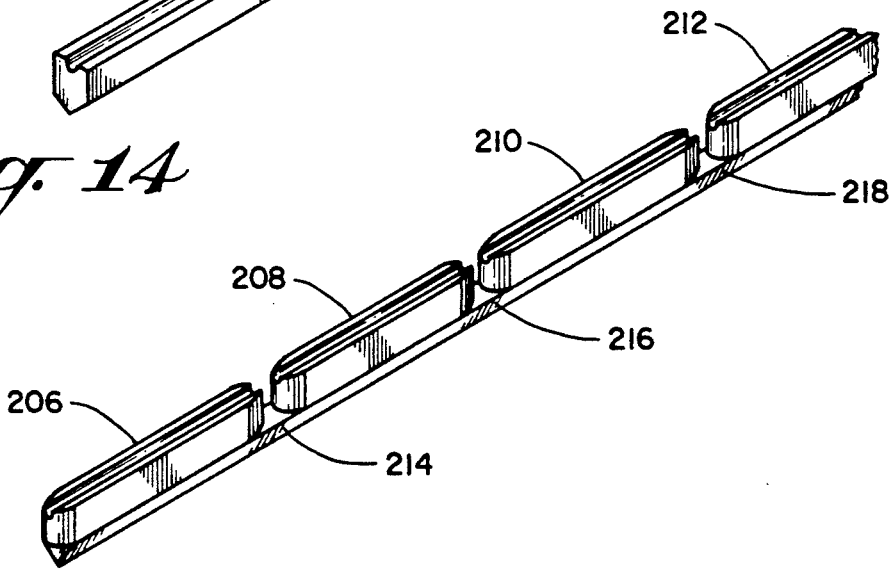

The segments can also be made by injection molding in the form shown by the train of segments 206–212 depicted in FIG. 15. Injection molding provides an advantage in that the corners can be rounded in the process. The segments are shown as being connected by webs 214–218 which can be removed by a cutting and shaping machine similar to the gang saw previously described. As many as 40 such segments can be molded simultaneously.

The ceramic segments can be made to a precision size by dry pressing and sintering the powdered ceramic composition. The ceramic formulation is thoroughly blended (homogenized) by wet mixing the ingredients and spray-drying them to a uniform, fine particle size. Particle size is typically −180 mesh+325 mesh, or less than 180 mesh (0.0031 inch) and greater than 325 mesh (0.0017 inch).

In the dry pressing process, the powder is compacted in a die on an automatic mechanical press. The powder is compressed into the desired segment shape between a top and bottom punch while confined on the sides by a die. By proper process control of particle size and bulk density of the power, the dimensions and unfired density of the pressed segments can be accurately predicted. A uniform and predictable unfired density will provide a uniform shrinkage upon sintering, and thus a sintered segment of very accurate size in its final form. The pressed segments are removed from the press, set on a refractory plate of required flatness and sintered in a desired temperature and time sequence to vitrify the composition and ensure that there will be no porosity; ceramic non-porosity is critical in vacuum tubes of the cathode ray tube type to prevent entrapment and later release of contaminants such as the slurries used in the phosphor screening process.

A significant factor in the fabrication of a mask support structure is the flatness/parallelism of the segments and the cost of the segments. The use of several shorter segments as opposed to a single segment on each side of the screen allows greater control of deflection parameters, resulting in improved flatness and parallelism. The use of smaller segments also allows for fabrication of the segments by dry pressing on an automatic mechanical press with consequent cost savings.

In the past, long unsegmented rails have been made by the extrusion process, a process that presents problems because of the higher moisture content which causes dimensional inaccuracies due to shrinkage when the rail is dried and fired. There is much less shrinkage in the dry-pressing process because of the lower moisture content, so the size and shape of the segments can be controlled and predicted more exactly. For convenience of handling in production, the sintered segments are first secured to the associated bridging member prior to attachment to the faceplate. The means of securement of the bridging member may comprise a solder glass which devitrifies at the previously cited temperature of 450 degrees C. Alternately, the means of securement may comprise the porcelain enamel previously described.

Solder glass is preferred for securement of the individual segments to the faceplate. The same solder glass used to secure the metal to the ceramic can be used since, once devitrified, the solder glass softens and deforms at a considerably higher temperature than the temperature at which it became devitrified. The coefficient of thermal contraction of the solder glass can be altered to place the glass beneath at least selected ones of the segments into a predetermined degree of tension, as fully described and claimed in referent copending application Ser. No. 458,129.

The top surface of each bridging member is preferably ground before attachment to the faceplate to provide a land for receiving the foil mask, and to ensure precise Q-spacing. The segments are first attached to the bridging member to form a rail assembly easy to handle in grinding production. The segments of the rail assembly are then secured to the inner surface of the faceplate.

Since the components of the rail assembly are precision made, in most applications, no expensive in situ grinding is necessary to provide a flat for receiving and securing the mask, and to provide the proper Q-height. "In situ grinding" is grinding by a separate operation after the rail assemblies comprising the support structure are secured to the faceplate. (Finish grinding of an in situ mask support structure is described and claimed in referent copending application Ser. No. 140,464 of common ownership herewith.) The precision of attachment of the support structures is enhanced by the accurate dispensing of the solder glass when in paste form onto the bottom of the segments prior to their attachment to the faceplate. Also, if porcelain enamel is used to secure the bridging member to the segments of a rail assembly, the thickness of the porcelain enamel can be held to within ±0.0008 inch, and the solder glass for securing the segments to the faceplate can be held to within ±0.001. In most tubes, a tolerance range of ±0.0033 inch in the height of the bridging member provides for a precision that makes it unnecessary to grind the top surface; only a cleaning of the surface may be all that is required.

For an interchangeable mask system, however, such as that described and claimed in referent copending applications Ser. Nos. 223,475, 370,204 and 405,378, the greater precision required makes mandatory the in situ grinding of the segmented mask support structure.

Since the segments are accurately sized, and have a slender, rectangular shape, they can be handled easily by automatic equipment well-known in the production art. The "saddle roof" configuration depicted in FIG. 4, and which is the subject of referent copending application Ser. No. 269,822, makes it easy to orient the individual segments properly for sintering as well as for the dispensing of solder glass and the mating with the bridging member which receives and secures the mask. A rail assembly can be handled as a unit for passing through the solderglass dispensing machine, and for automatic installation on the inner surface of the faceplate.

The minimization of distortion in the faceplate provided by the segmented mask support structure according to the invention, makes feasible the application of the flat tension mask technology to—

(1) Cathode ray tubes of relatively large size; e.g., 35 inches in diagonal measure;

(2) Interchangeable mask systems;

(3) Large-screen, high-definition television systems;

(4) Projection systems.

The simplification of the production process and automated handling of components, makes possible the elimination of many complex and expensive production steps presently used. Also, cost reductions are achieved through reduced need of expensive materials such as the alloy used for the bridging members.

While a particular embodiment of the invention has been shown and described, it will be readily apparent to those skilled in the art that changes and modifications may be made in the inventive means and process without departing from the invention in its broader aspects, and therefore, the aim of the appended claims is to cover all such changes and modifications as fall within the true spirit and scope of the invention.

We claim:

1. A color cathode ray tube including a glass faceplate having on its inner surface a centrally disposed, rectangular screen, and attached to the faceplate on each of opposed sides of said screen a plurality of discrete mask support segments to which are secured a tensed foil shadow mask, at least selected ones of said segments having different lengths.

2. The tube defined by claim 1 wherein said segments include an end segment which is longer than a centrally located segment.

3. A color cathode ray tube including a glass faceplate having on its inner surface a centrally disposed, rectangular screen, and attached to the faceplate on each of opposed sides of said screen a plurality of discrete ceramic mask support segments to which are secured a tensed foil shadow mask, said segments each having rounded ends, said discrete rounded ends being polar on the longitudinal axes of each of said opposed screen sides, said rounded ends effective to minimize stresses in said faceplate inner surface.

4. A color cathode ray tube including a glass faceplate having on its inner surface a centrally disposed, rectangular screen, and attached to the faceplate on each of opposed sides of said screen a plurality of mask support segments bridged by a bridging member to which is secured a tensed foil shadow mask.

5. A color cathode ray tube including a glass faceplate having on its inner surface a centrally disposed, rectangular screen, and attached to the faceplate on each side of said screen a plurality of mask support segments bridged and held by a metal bridging member to which is secured a tensed foil shadow mask.

6. The tube according to claim 4 or 5 wherein at least selected ones of said segments vary in length in a conformation effective to disperse stress in said glass of said faceplate.

7. A color cathode ray tube including a glass faceplate having on its inner surface a centrally disposed, rectangular screen, and a metal foil shadow mask mounted in tension on a mask support structure secured to said inner surface by devitrifying solder glass, said support structure surrounding said screen and comprising a predetermined plurality of discrete, spaced ceramic segments having ends configured to reduce stress concentrations in said glass of said faceplate, said segments bridged by a bridging member having at least one thermal expansion gap therein and secured to the segments for receiving and securing said mask.

8. A color cathode ray tube including a glass faceplate having on its inner surface a centrally disposed, rectangular screen, and a metal foil shadow mask mounted in tension on a mask support structure comprising four discrete rails located on each of opposed sides of said screen and secured to said inner surface by devitrifying solder glass, each of said rails of said support structure comprising a predetermined plurality of discrete, spaced ceramic segments having ends configured to reduce stress concentrations in said glass of said faceplate, and spaced apart a distance effective to prevent intersection of stress lines in said glass emanating from the ends of said segments, said segments bridged by a bridging member having at least one thermal expansion gap therein and secured to the segments for receiving and securing said mask.

9. The apparatus according to claim 8 wherein at least selected ones of said segments vary in length in a conformation effective to disperse stress in said glass of said faceplate.

10. A color cathode ray tube including a glass faceplate having on its inner surface a centrally disposed, rectangular screen and attached to the faceplate on each of opposed sides of the screen a plurality of discrete mask support segments to which are secured a tensed foil shadow mask, at least selected ones of said segments having different coefficients of thermal contraction.

11. The cathode ray tube defined by claim 10 wherein of the plurality of mask support segments along one side of the screen, the end segments have a coefficient of thermal contraction less than that of a segment or segments intermediate said end segments.

12. A color cathode ray tube including a glass faceplate having on its inner surface a centrally disposed, rectangular screen that has attached to the faceplate on each of opposed sides of the screen a rail formed of a plurality of discrete mask support segments for receiving a tensed foil shadow mask, at least the end segments of said rails being composed of a material having a lower coefficient of thermal contraction than said glass of said faceplate.

13. A color cathode ray tube including a glass faceplate having on its inner surface a centrally disposed, rectangular screen, and on each side thereof a plurality of discrete mask support segments to which are secured a tensed foil shadow mask, at least selected ones of said segments being composed of a material having a lower coefficient of thermal contraction than the coefficient of thermal contraction of said glass of said faceplate.

14. A color cathode ray tube including a glass faceplate having on its inner surface a centrally disposed, rectangular screen which has attached to the faceplate on each of opposed sides of the screen a plurality of discrete mask support segments to which are secured a tensed foil shadow mask, at least selected ones of said segments having different lengths and different coefficients of thermal contraction.

* * * * *